US010495297B2

(12) United States Patent
Boss

(10) Patent No.: US 10,495,297 B2
(45) Date of Patent: Dec. 3, 2019

(54) ILLUMINATED PONYTAIL HOLDER

(71) Applicant: Dimitry R Boss, Hillsdale, NJ (US)

(72) Inventor: Dimitry R Boss, Hillsdale, NJ (US)

( * ) Notice: Subject to any disclaimer, the term of this patent is extended or adjusted under 35 U.S.C. 154(b) by 0 days.

(21) Appl. No.: 16/357,162

(22) Filed: Mar. 18, 2019

(65) Prior Publication Data

US 2019/0285266 A1 Sep. 19, 2019

Related U.S. Application Data

(60) Provisional application No. 62/644,973, filed on Mar. 19, 2018.

(51) Int. Cl.

| | |
|---|---|
| ***F21V 33/00*** | (2006.01) |
| ***A45D 8/34*** | (2006.01) |
| ***A45D 8/30*** | (2006.01) |
| ***H05B 33/08*** | (2006.01) |
| ***H05B 37/02*** | (2006.01) |
| ***F21L 4/02*** | (2006.01) |

(Continued)

(52) U.S. Cl.

CPC ..... *F21V 33/0008* (2013.01); *A45D 8/30* (2013.01); *A45D 8/34* (2013.01); *F21L 4/02* (2013.01); *H05B 33/0845* (2013.01); *H05B 33/0863* (2013.01); *H05B 37/0236* (2013.01); *H05B 37/0272* (2013.01); *A45D 2008/006* (2013.01); *F21Y 2115/10* (2016.08)

(58) Field of Classification Search

CPC ..... F21V 33/0008; A45D 8/30; A45D 8/34; F21L 4/02; H05B 33/0845; H05B 33/0863; H05B 33/0236; H05B 33/0272

USPC ..... 362/105

See application file for complete search history.

(56) References Cited

U.S. PATENT DOCUMENTS 2,405,384 A * 8/1946 White ..... A44C 5/00 362/104
2,445,071 A * 7/1948 Kovacs ..... A45D 8/34 132/133

(Continued)

FOREIGN PATENT DOCUMENTS

GB 2219741 A 12/1989

OTHER PUBLICATIONS

Hair Cuff Cone, http://www.shopmadeinchina.com/product-image/fashion-Big-Metallic-Metal-Mirror-Hair-Cuff-CONE_13922383.shtml.

(Continued)

*Primary Examiner* — Bryon T Gyllstrom
(74) *Attorney, Agent, or Firm* — QuickPatents, LLC; Kevin Prince

(57) ABSTRACT

A ponytail holder includes a frustoconical base having first and second parts each mutually hinged to move between an open position and a closed position about the ponytail. The bottom edge of the base is at least partially covered with an electrically conductive surface. A frustoconical cover is fixable with the base and includes at least two conductive projections each adapted for a snap fit with the bottom edge of the base to mechanically and electrically secure the cover to the base. A plurality of LEDs fixed with the cover are connected to the battery when the cover is engaged with the base. A controller provides power from the battery to the LEDs in a variety of ways to create a unique lighting effect based on a rotational position of the cover, an ambient sound level, a selected lighting mode, or a wireless command signal.

15 Claims, 5 Drawing Sheets

(51) Int. Cl.
*F21Y 115/10* (2016.01)
*A45D 8/00* (2006.01)

(56) References Cited

U.S. PATENT DOCUMENTS 2,798,148 A * 7/1957 La Greca ..... A44C 7/00 362/103
3,790,775 A 2/1974 Rosenblatt
4,604,760 A * 8/1986 Coin ..... A42B 5/00 2/171
4,912,944 A 4/1990 Crosley
4,998,186 A * 3/1991 Cocca ..... A44C 15/0015 132/275
4,999,747 A * 3/1991 Chen ..... A44C 15/0015 362/103
5,535,765 A 7/1996 Takashima
D385,061 S * 10/1997 Malik ..... D28/41
5,937,867 A 8/1999 Williams
6,089,240 A 7/2000 Chang
6,276,368 B1 8/2001 Giamalva
6,302,554 B1 10/2001 Holce
6,311,699 B1 * 11/2001 Horman ..... A45D 8/24 132/273
6,688,316 B1 2/2004 Klug
7,963,289 B1 6/2011 King
8,752,561 B1 6/2014 Wendschuh
9,301,586 B1 * 4/2016 Jones ..... A45D 8/26
2008/0149130 A1 * 6/2008 Brown ..... A45D 8/34 132/279
2009/0109660 A1 4/2009 Duther
2010/0277944 A1 11/2010 Hurwitz
2011/0267812 A1 * 11/2011 Van De Ven ..... F21K 9/00 362/235
2013/0014777 A1 1/2013 Moore
2013/0128555 A1 5/2013 Brauser et al.
2013/0186424 A1 * 7/2013 Zachery ..... A45D 8/34 132/275
2013/0192626 A1 * 8/2013 Cohen ..... A45D 8/00 132/275
2015/0164188 A1 6/2015 Gelfand et al.

OTHER PUBLICATIONS

Ridged Cone Hair Cuff, http://www.polyvore.com/silver_ridged_cone_hair_cuff/thing?id=64707381.

* cited by examiner

ILLUMINATED PONYTAIL HOLDER

CROSS-REFERENCE TO RELATED APPLICATIONS

This application claims the benefit of U.S. Provisional Patent Application 62/644,973, filed on Mar. 19, 2018, and incorporated herein by reference.

STATEMENT REGARDING FEDERALLY SPONSORED RESEARCH AND DEVELOPMENT

Not Applicable.

FIELD OF THE INVENTION

This invention relates to hair accessories, and more particularly to an illuminated ponytail holder with an interchangeable outer cover.

DISCUSSION OF RELATED ART

Ponytail holders are known in the art for keeping a person's ponytail intact and in place on her head. Such holders take the form of a two-part circular, cylindrical, or conical shape through which the ponytail is inserted and held in place thereby. Some prior art holders have interlacing teeth, such as U.S. Pat. No. 2,445,071 to Kovacs et al. on Feb. 7, 1947; U.S. Pat. No. 5,937,867 to Williams on Aug. 17, 1999; U.S. Pat. No. 7,963,289 to King on Jun. 21, 2011; and U.S. Pat. No. 6,311,699 to Horman on Nov. 6, 2001. Such prior art devices may hold a ponytail intact for a while, but throughout the day and with movement of the person's head the ponytail frequently dislodges from a single row of teeth or spikes.

U.S. Pat. No. 6,089,240 to Chang on Jul. 18, 2000 teaches a hair grip device having two rows of elastic plates that serve to compress the ponytail therebetween. Such a device includes an outer flange that is used to open the device to insert the ponytail, yet the flange is a mechanical contraption that interrupts the outward appearance of the product. Further, with such a device there is no provision for changing the appearance, color, pattern, or other decorative features, which women and girls often desire in order to match a particular outfit, mood or hairstyle. Moreover, once the elastic plates of such a product become worn and ineffective, there is no provision for replacing them without replacing the entire device. So-called "hair cones" and "hair cuffs" sold over the Internet have similar disadvantages.

None of the prior art ponytail holders include illumination means, and certainly none include means by which the color, brightness, and/or pattern of the illumination can be set, changed or synchronized with similar ponytail holders in the surrounding area. None of the prior art teach a ponytail holder that can have different color, pattern, brightness, or LED distribution based on which cover is used, or that change colors based on signals received from a mobile electronic device such as a so-called "smart phone."

Therefore, there is a need for a device will securely hold a ponytail even with continual movement of the person over the course of a day. Such a needed invention would provide means for quickly changing the outward appearance of the device, and would provide for selectable color lighting effects either in a stand-alone mode, in synchronization with surrounding ponytail holders, or as commanded by a mobile electronic device. The present invention accomplishes these objectives.

SUMMARY OF THE INVENTION

The present device is a ponytail holder for holding the ponytail of a person. A frustoconical base has a first part and a second part each mutually connected at a hinged edge and positionable between an open position and a closed position. Each part has an inner surface and an outer surface, and a clasping edge opposite the hinged edge. The clasping edge of each part is mutually, selectively fastenable to secure the base in the closed position about the person's ponytail. Each part has a top edge and a bottom edge that together, when the base is in the closed position, form a top opening of the base and a bottom opening of the base.

In some embodiments, the clasping edge of each part includes electrical contacts that form an electrical clasp switch that is closed when the base is in the closed position and that is open when the base is in the open position. In such embodiments, a plurality of base LEDs are electrically connected with a base battery fixed with the base through a plurality of conductors fixed with the base, so as to illuminate the base LEDs only when the clasp switch is closed.

In some embodiments, the base may further include a controller electrically connected between the base battery and the base LEDs. An electric base mode switch can be included to switch the base controller into different base LED lighting modes, such as power on, power off, flashing, pulsating, random, mobile-phone-commanded, or other modes as may be programmed into the base controller.

In some embodiments, the base controller is further connected with a microphone and adapted to vary the brightness and color of the base LEDs based on a predetermined sound level detected by the microphone. Alternately, or additionally, the ponytail holder may further include a wireless receiver with an antenna for receiving a signal to control the color and brightness of the base LEDs. In such an embodiment each base LED is preferably separately connected with the conductors to the base controller, and the base controller can control the pattern and color of the base LEDs illuminated based on a wireless signal received by the base controller.

Preferably each part of the base further includes a plurality of freestanding parallel spikes projecting away therefrom, the spikes of both parts of the base being substantially mutually parallel when the base is in the closed position, and preferably at least partially overlapping. As such the ponytail holder is held in place on the head of the person by the spikes engaging the person's ponytail.

In preferred embodiments a frustoconical cover is fixable with the base when the base is in the closed position. The cover includes an outer surface, an inner surface adapted to abut the outer surface of each part of the base, a top opening and a bottom opening. In some embodiments the cover is at least partially non-opaque so that base LEDs may be at least partially visible therethrough when the cover is engaged with the base. In some embodiments the cover is electrically inert and only serves to optically filter light emanating from the base LEDs.

Preferably the bottom edge of each part is at least partially covered with a conductive surface. The base battery is fixed with the base, each pole of the base battery connected either with the base LEDs or one of the conductive surfaces of each of the bottom edges of each part of the base. In such embodiments the cover includes at least two conductive inward projections proximate the bottom opening of the cover. Each projection is adapted for a snap fit with the bottom edge at the conductive surfaces of the base to mechanically and electrically secure the cover to the base.

In embodiments having the conductive projections on the cover, preferably the cover further includes a cover battery, a cover mode switch, a cover controller, the wireless receiver in communication with the cover controller, and a plurality of cover LEDs. In such embodiments the cover LEDs are active preferably over any base LEDs, as a resistor may be included in the base to divert electricity to the cover when the cover is present. As such, the base may be active and illuminating the base LEDs until the cover is engaged with the base, thereafter the cover LEDs being active in preference to the base LEDs. The cover LEDs are preferably driven by the cover controller as determined by selection of one of the illumination modes through the cover mode switch. This can be accomplished simply by allowing the base battery to be brought into a parallel relationship with the cover battery. Indeed, in some embodiments the base may only include the base battery and not the base LEDs, the base controller, or the base mode switch.

The wireless control signal sent to the base controller or cover controller through the wireless receiver may originate with, for example, a phone of the person, or other mobile electronic device such as a lighting controller at a concert. In such an embodiment, the mobile phone may set the color of the LEDs to any desired color desired by the person, or by the person taking a photograph with the mobile phone of a color such as a color of a garment, for example. As such, the color of the LEDs can be made to match a color in outfit or garment of the person.

The present invention securely holds a ponytail even with continual movement of the person over the course of a day. The present invention provides means for quickly changing the outward appearance of the device, and provides for selectable color lighting effects either in a stand-alone mode or in synchronization with surrounding ponytail holders through a wireless signal from a mobile phone or other controller. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
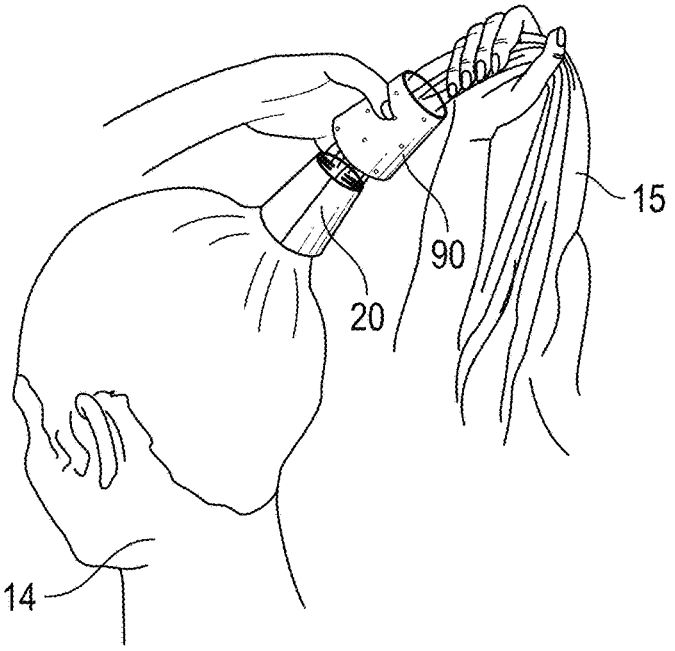
FIG. 1 is a perspective view of a person fitting the invention to her ponytail.
Figure 2:
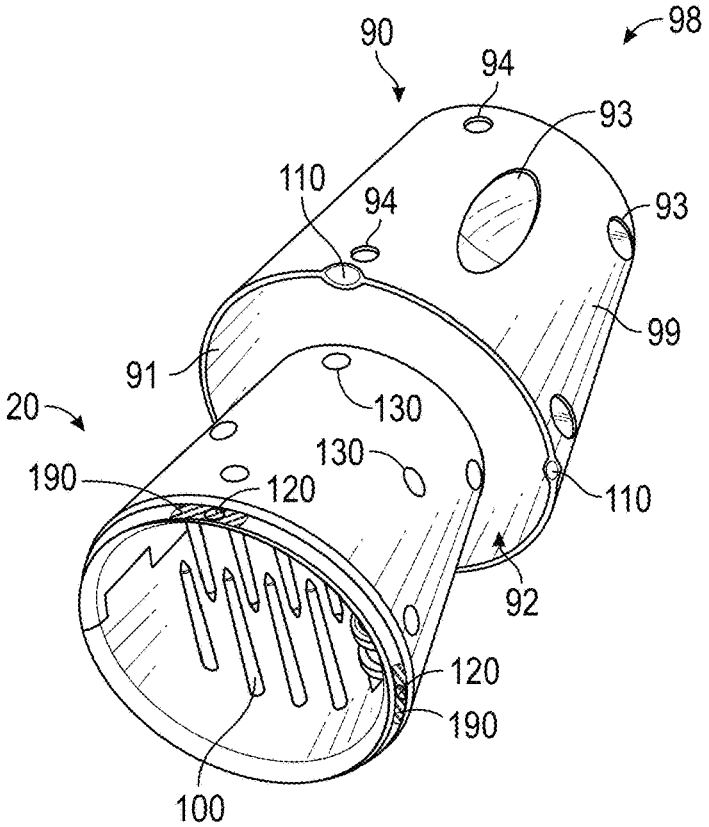
FIG. 2 is an exploded bottom perspective view of the invention.
Figure 3:
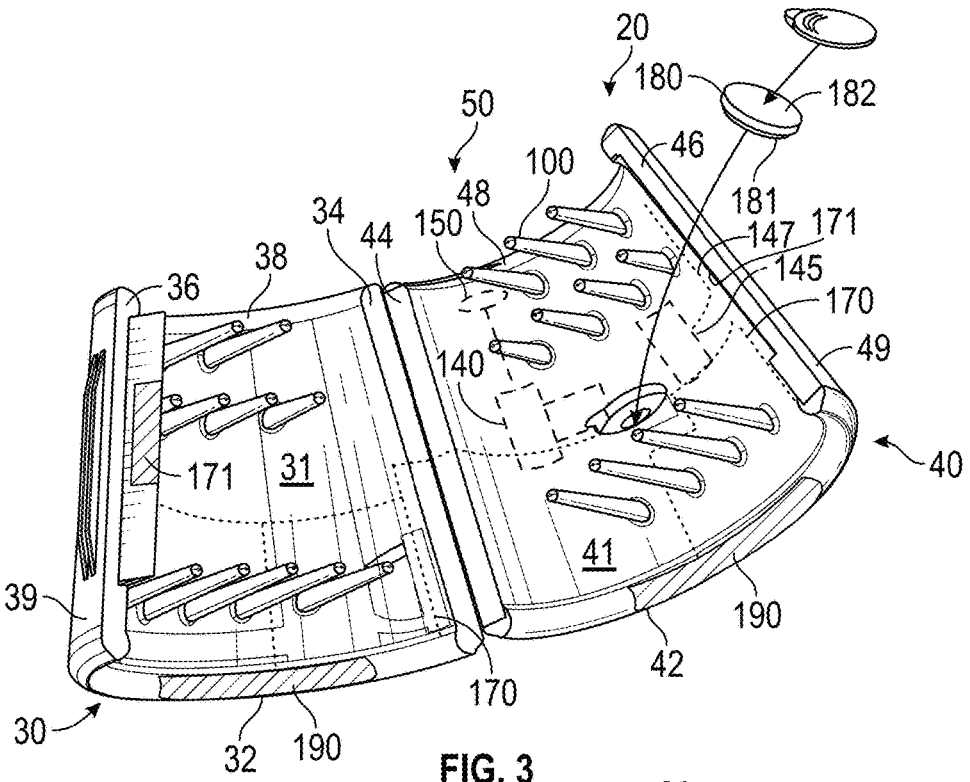
FIG. 3 is a perspective view of a base of the invention in an open configuration, a battery thereof exploded away therefrom.

FIGS. 1-3 illustrate a ponytail holder 10 for holding the ponytail 15 of a person 14. A frustoconical base 20 has a first part 30 and a second part 40 each mutually connected at a hinged edge 34,44 and positionable between an open position 50 (FIG. 3) and a closed position 60 (FIGS. 1 and 2). Each part 30,40 has an inner surface 31,41 and an outer surface 39,49, and a clasping edge 36,46 opposite the hinged edge 34,44. The clasping edge 36,46 of each part 30,40 is mutually, selectively fastenable to secure the base 320 in the closed position 60 about the person's ponytail 15. Each part 30,40 has a top edge 38,48 and a bottom edge 32,42 that together, when the base 20 is in the closed position 60, form a top opening 70 of the base 20 and a bottom opening 80 of the base 20. Preferably the base 20 is formed from a plastic injection molding method as an integral piece.

Figure 7A:
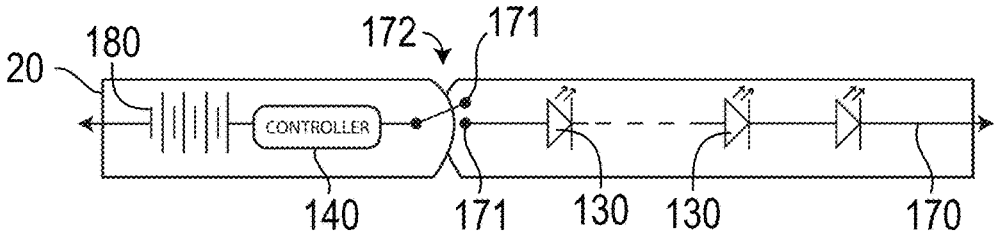
FIG. 7A is a block diagram of electrical components of a first embodiment of the invention, illustrating a base having a base battery, a controller, a clasp switch, and a plurality of the LEDs.

In some embodiments, the clasping edge 36,46 of each part 30,40 includes electrical contacts 171 (FIGS. 3 and 7A) that form an electrical clasp switch 172 that is closed when the base 20 is in the closed position 60 and that is open when the base 20 is in the open position 50. In such embodiments, a plurality of base LEDs 130 are electrically connected with a base battery 180 fixed with the base 20 through a plurality of conductors 170 fixed with the base 20, so as to illuminate the base LEDs 130 only when the clasp switch 172 is closed.

Figure 4:
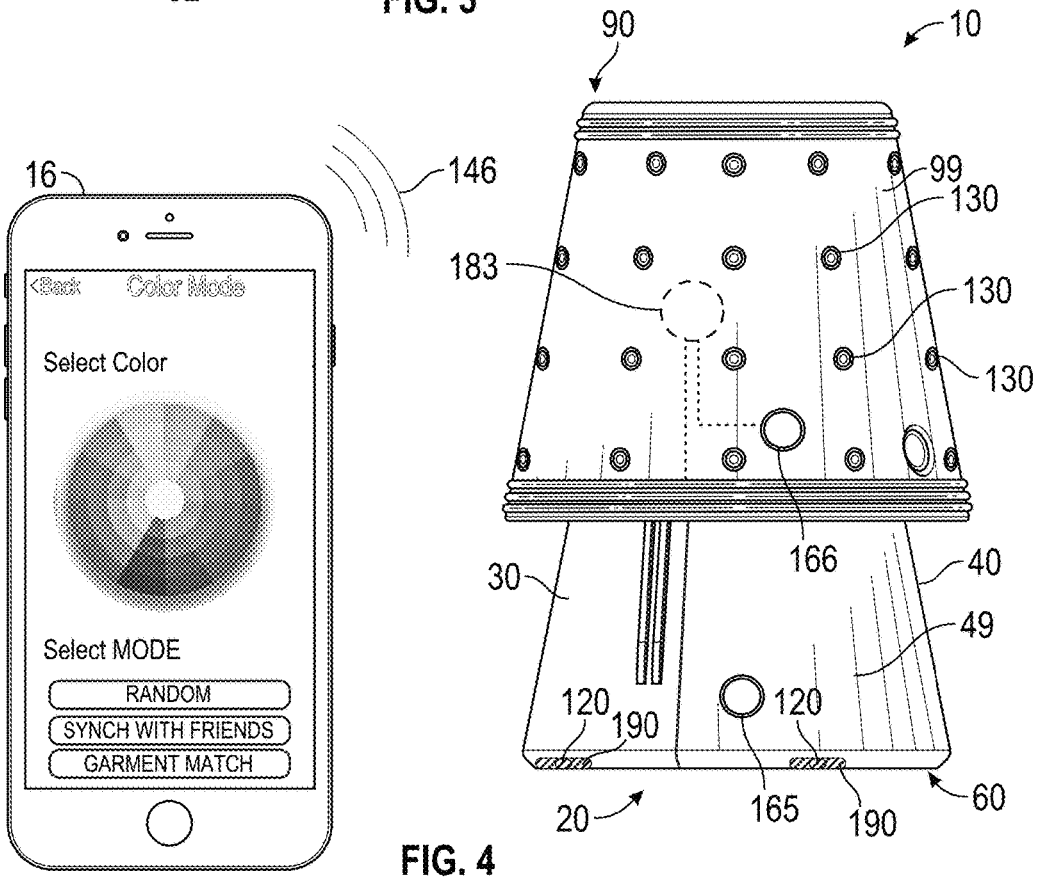
FIG. 4 is a side elevational view of the invention, illustrating a cover of the invention being fitted over the base of the invention and a mobile electronic device sending a signal to a controller of the invention.
Figure 5:
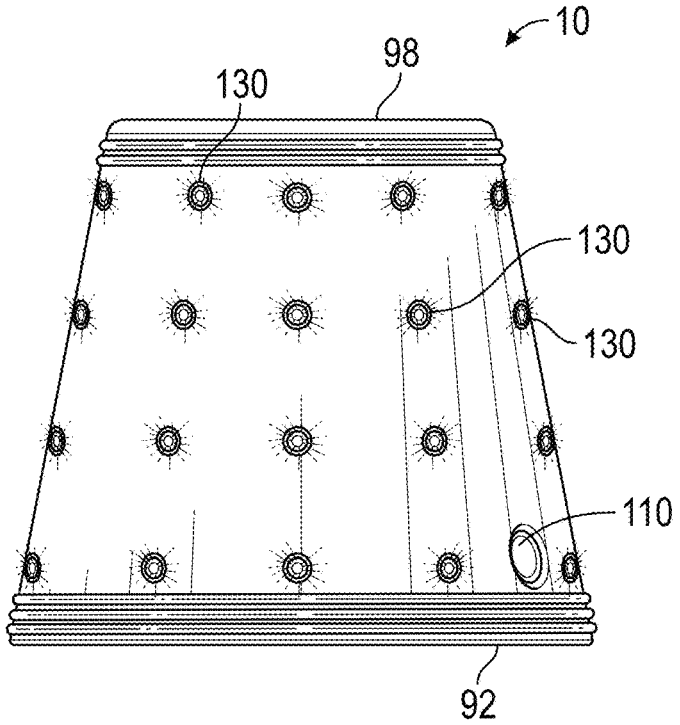
FIG. 5 is a side elevational view of the invention, showing the cover engaged with the base to power a plurality of LEDs.
Figure 7B:
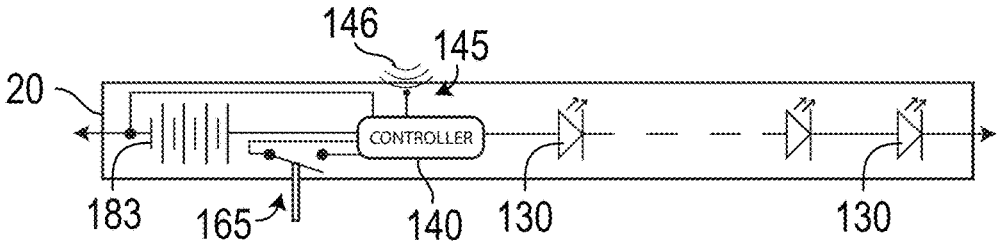
FIG. 7B is a block diagram of electrical components of a second embodiment of the invention having a mode switch and a wireless receiver.

In some embodiments, the base 20 may further include a controller 140 electrically connected between the base battery 180 and the base LEDs 130. An electric base mode switch 165 (FIGS. 4 and 7B) can be included to switch the base controller 140 into different base LED lighting modes, such as power on, power off, flashing, pulsating, random, mobile-phone-commanded, or other modes as may be programmed into the base controller 140. In such an embodiment, as long as one of the lighting modes is power off, the clasp switch 172 may be removed during manufacturing if desired. The base controller 140 is preferably an integrated circuit chip designed to power the base LEDs 130 in the various lighting modes.

In some embodiments, the base controller 140 is further connected with a microphone 150 and adapted to vary the brightness and color of the base LEDs 130 based on a predetermined sound level detected by the microphone 150 (FIG. 3). Alternately, or additionally, the ponytail holder 10 may further include a wireless receiver 145 (FIGS. 4 and 7B) with an antenna 147 for receiving a signal 146 to control the color and brightness of the base LEDs 130. In such an embodiment each base LED 130 is preferably separately connected with the conductors 170 to the base controller 140, and the base controller 140 can control the pattern and color of the base LEDs 130 illuminated based on a wireless signal 146 received by the base controller 140.

Figure 6:
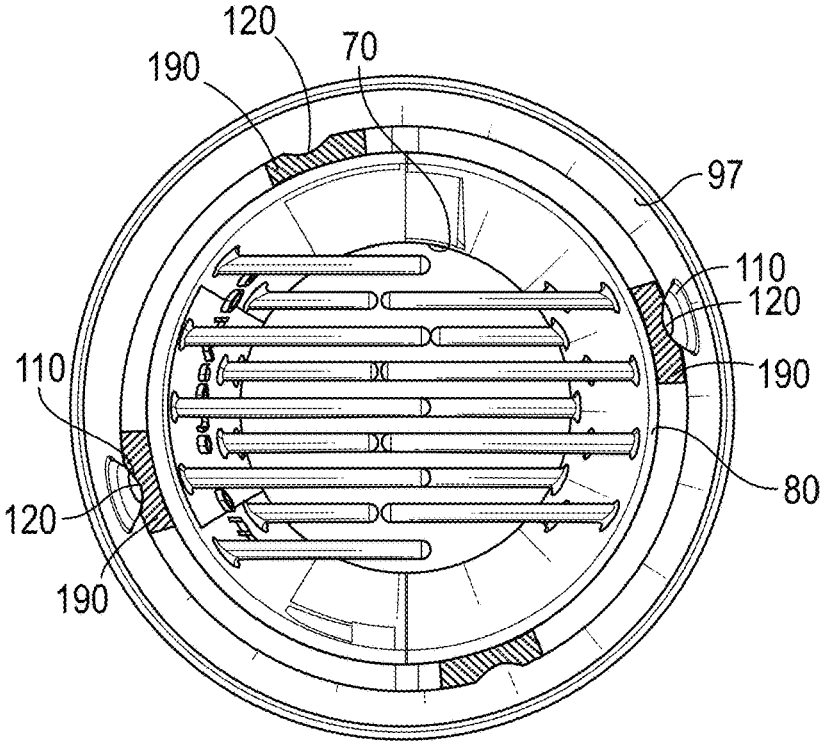
FIG. 6 is a bottom plan view of FIG. 5.

Preferably each part 30,40 of the base 20 further includes a plurality of freestanding parallel spikes 100 (FIGS. 2, 3 and 6) projecting away therefrom, the spikes 100 of both parts 30,40 of the base 20 being substantially mutually parallel when the base 20 is in the closed position 60, and preferably at least partially overlapping. As such the ponytail holder 10 is held in place on the head of the person 14 by the spikes 100 engaging the person's ponytail 15.

In preferred embodiments a frustoconical cover 90 is fixable with the base 20 when the base 20 is in the closed position 60 (FIGS. 4-6, 7C-7E). The cover 90 includes an outer surface 99, an inner surface 91 adapted to abut the outer surface 39,49 of each part 30,40 of the base 20, a top opening 98 and a bottom opening 92. Preferably the cover 90 is made from a plastic injection molded process. In some embodiments the cover 90 is at least partially non-opaque so that base LEDs 130 may be at least partially visible therethrough when the cover 90 is engaged with the base 20. In some embodiments the cover 90 is electrically inert and only serves to filter light emanating from the base LEDs 130.

Figure 7C:
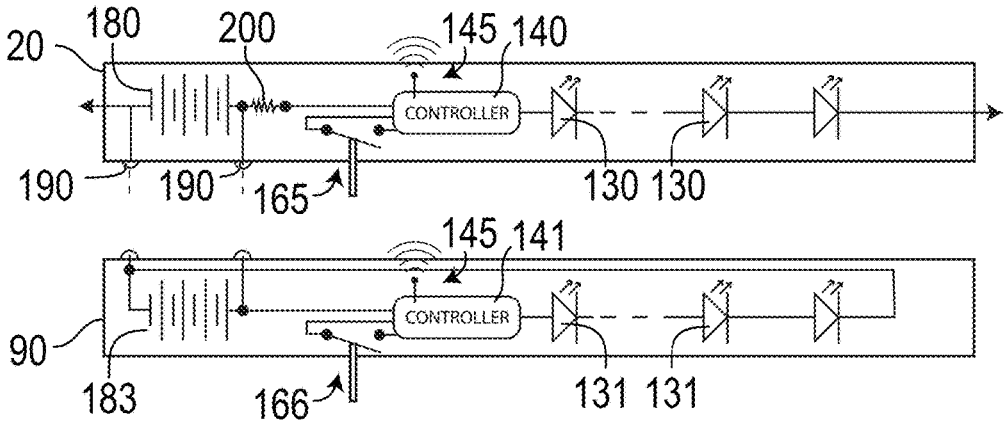
FIG. 7C is a block diagram of electrical components of a fourth embodiment of the invention wherein the cover also includes cover LEDs, a cover controller, a cover mode switch, and a cover battery, wherein when engaged with the base the base battery powers the cover LEDs and the base LEDs remain off.
Figure 7D:
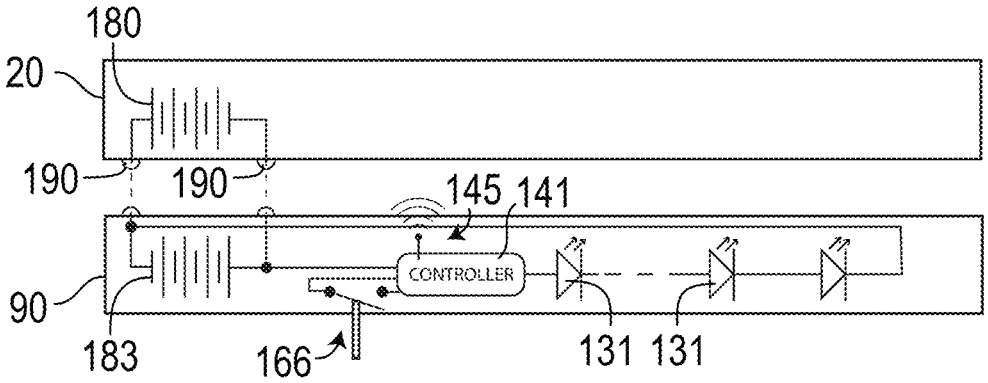
FIG. 7D is a block diagram of electrical components of a fifth embodiment of the invention wherein the base only supplies power to the cover and does not have the base controller, base LEDs, or base mode switch.
Figure 7E:
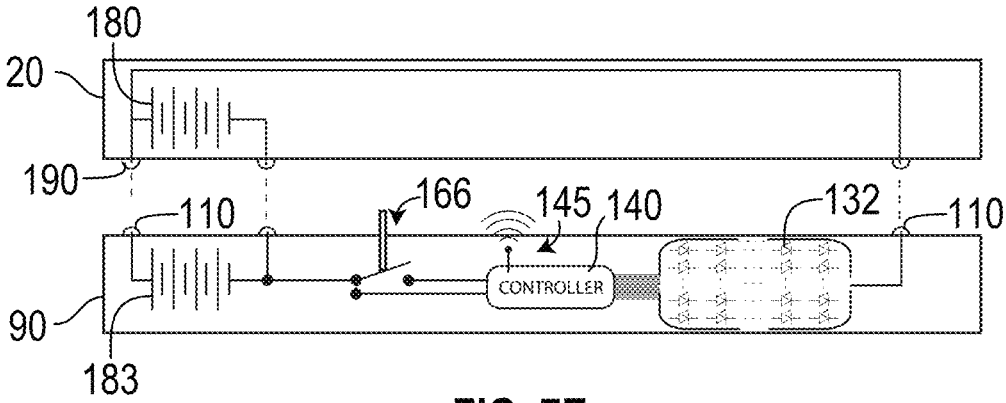
FIG. 7E is a block diagram of electrical components of the fifth embodiment of the invention wherein the plurality of cover LEDs are an LED or LCD display screen material, and wherein the base acts as the cover switch to activate the cover controller.

Preferably the bottom edge 32,42 of each part 30,40 is at least partially covered with a conductive surface 190 (FIGS. 7C-7E). The base battery 180 is fixed with the base 20, each pole 181,182 (FIG. 3) of the base battery 180 connected either with the base LEDs 130 or one of the conductive surfaces 190 of each of the bottom edges 32,42 of each part 30,40 of the base 20. Alternately, a separate battery pack (not shown) can be tethered to the base 20 outside of the base 20, such as within the ponytail 15, or clipped to another part of the head of the person 14. Preferably the base battery 180 is a relatively flat coin-type battery that can be at least partially contained within the base 20.

In such embodiments the cover 90 includes at least two conductive inward projections 110 proximate the bottom opening 92 of the cover 90. Each projection 110 is adapted for a snap fit with the bottom edge 38,48 at the conductive surfaces 190 of the base 20 to mechanically and electrically secure the cover 90 to the base 20. The projections 110 may be at the bottom opening 92 (FIG. 2), or raised slightly upwardly from the bottom opening 92 (FIGS. 4-6) to cause the cover 90 to tighten further on the ponytail 15 and the person's head to inhibit the ponytail holder 10 from wobbling on the person's head.

In embodiments having the conductive projections 110 on the cover 90 (FIGS. 7C-7E), preferably the cover 90 further includes a cover battery 183, a cover mode switch 166, a cover controller 141, the wireless receiver 145 in communication with the cover controller 141, and a plurality of cover LEDs 131. In such embodiments the cover LEDs 131 are active over any base LEDs 130, as a resistor 200 (FIG. 7C) may be included in the base 20 to divert electricity to the cover 90 when the cover 90 is present, as the components of the base 20 would otherwise have essentially the same resistance as those of the cover 90. Resister 200 may be set at, for example, 1000 Ohms. Alternately, a bypass switch (not shown) may be included to open circuit of the base 20 when the cover 90 is present. As such, the base 20 may be active and illuminating the base LEDs 130 until the cover 90 is engaged with the base 20, thereafter the cover LEDs 131 being active in preference to the base LEDs 130. The cover LEDs 131 are preferably driven by the cover controller 141 as determined by selection of one of the illumination modes through the cover mode switch 166. This can be accomplished simply by allowing the base battery 180 to be brought into a parallel relationship with the cover battery 183, as illustrated in FIGS. 7C-7E. Indeed, in some embodiments the base 20 may only include the base battery 180 and not the base LEDs 130, the base controller 140, or the base mode switch 165.

Cover LEDs 131 (similar to base LEDs 130, which for the purposes of this disclosure may not be light-emitting diodes per se but may also be other lamps or electric illumination sources as becomes known in the art) are fixed with the cover 90, each cover LED 131 being connected with the conductive projections 110 of the cover 90 to connect the cover LED 131 to the base battery 180 when the cover 90 is engaged with the base 20. Such cover LEDs 131 may be a single display screen material 132 (FIG. 7E) with pixels of the display screen each acting as the cover LEDs 131. Such a display screen material 132 may include, for example, a bendable or curved high-resolution display matrix as is known in the art, and may be used on the base 20 (not shown) with an at least partially-transparent cover 90, or on the cover 90 itself (FIG. 7E) in embodiments wherein a cover controller 141 is also included with the cover 90.

In some embodiments, the base 20 includes a plurality of recesses 120 that act as detents in the bottom edge 32,42 of the base 20, each electrically isolated from the others and adapted for mechanically and electrically engaging one of the projections 110 of the cover 90. Opposing pairs of the recesses 120 provide power from the base battery 180 to the LEDs 130,131. Optionally in such embodiments, portions 33,43 of the bottom edge 32,42 of the base 20 between recesses 120 are devoid of the conductive surface 190 (FIG. 6), such that when the projections 110 of the cover 90 are positioned between recesses 20 of the base 20, power from the base battery 180 is not supplied to any of the LEDs 130,131 and the LEDS 130,131 are in an off state.

The wireless control signal 146 sent to the base controller 140 or cover controller 141 through the wireless receiver 145 may originate with, for example, a phone 16 (FIG. 4) of the person 14, or other mobile electronic device such as a lighting controller at a concert (not shown). In such an embodiment, the mobile phone 16 may set the color of the LEDs 130,131 to any desired color desired by the person 14, or by the person 14 taking a photograph with the mobile phone 16 of a color such as a color of a garment (not shown), for example. As such, the color of the LEDs 130,131 can be made to match a color in outfit or garment of the person 14.

In some embodiments wherein the base 20 includes the base LEDs 130 each connected with the base battery 180 through the base mode switch 165 (or the base controller 140) and a plurality of the conductors 170, the cover 90 includes non-opaque areas 93 (FIG. 2) or apertures 94 therethrough, such that light from the LEDs 130,131 of the base can be seen through the cover 90. Such apertures may be circular as illustrated, or elongated slots (not shown), or the like. Such non-opaque areas 93 may be translucent, include one or more color or prism filters, or the like.

Accordingly, a variety of different covers 90 may be available, or included in a kit (not shown) that also includes the base 20. The covers 90 are interchangeable and preferably include a variety of appearances and colors. Moreover, each cover 90 may include a unique pattern or set of colored LEDs 130 so that, for example, one cover may include a red-white-and-blue patriotic theme, while another cover includes a Christmas holiday red-and-green theme. Even with the LEDs 130,131 off (such as if the base battery 180 runs low, for example) the outer surface 99 of each cover 90 may include a unique color and/or pattern.

While a particular form of the invention has been illustrated and described, it will be apparent that various modifications can be made without departing from the spirit and scope of the invention. For example, the LEDs 130,131 may be alternate light sources such as electroluminescent film or wire, or the like. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. A ponytail holder, comprising:

a frustoconical base having first and second parts each mutually connected at a hinged edge and positionable between open and closed positions, each part having an inner surface, an outer surface, and a clasping edge opposite the hinged edge, the clasping edge of each part mutually, selectively fastenable to secure the base in the closed position, each part having a top edge and a bottom edge that together form a top opening and a bottom opening, respectively, when the base is in the closed position;

a base battery fixed with the base and electrically connected with a plurality of base LEDs through a plurality of conductors fixed with the base and a base controller, base controlling the color and intensity of the base LEDs; and a base mode switch electrically connected with the base controller to alternate between illumination modes preprogrammed in the base controller.

2. The ponytail holder of claim 1 wherein the base further includes a wireless receiver electrically connected with the base controller for receiving a signal to command the base controller to control the color and brightness of each LED.

3. The ponytail holder of claim 1 wherein the bottom edge of each part is at least partially covered with a conductive surface and electrically connected to opposing sides of the base battery, a resister having a first resistance included in the base between the base battery and the plurality of LEDs, the ponytail holder further including:

a frustoconical cover fixable with the base when the base is in the closed position, the cover including an outer surface, an inner surface adapted to abut the outer surface of each part of the base, a top opening and a bottom opening;

the cover including at least two conductive inward projections proximate the bottom opening of the cover, each projection adapted for a snap fit with the bottom edge of the base to mechanically and electrically secure the cover to the base;

a plurality of cover LEDs fixed with the cover, each cover LED connected with the conductive projections of the cover to connect the cover LED to the base battery when the cover is engaged with the base;

whereby the cover LEDs fixed with the cover have a lower resistance than the base LEDs, such that when the cover is engaged with the base electricity only flows through the cover LEDs.

4. The ponytail holder of claim 3 further including:

a cover controller electrically fixed between the cover LEDs and the base battery when the cover is engaged with the base, the cover controller controlling the color and intensity of the cover LEDs; and a cover mode switch electrically connected with the cover controller to alternate between illumination modes pre-programmed in the cover controller.

5. The ponytail holder of claim 4 wherein the cover controller further includes a wireless receiver for receiving a signal to command the cover controller to control the color and brightness of each cover LED.

6. The ponytail holder of claim 4 wherein the cover further includes a cover battery electrically connected to the base battery of the base in parallel when the cover is engaged with the base.

7. The ponytail holder of claim 4 wherein each part of the base further includes a plurality of freestanding parallel spikes projecting away therefrom, the spikes of both parts of the base being substantially mutually parallel when the base is in the closed position.

8. A ponytail holder, comprising:

a frustoconical base having first and second parts each mutually connected at a hinged edge and positionable between open and closed positions, each part having an inner surface, an outer surface, and a clasping edge opposite the hinged edge, the clasping edge of each part mutually, selectively fastenable to secure the base in the closed position, each part having a top edge and a bottom edge that together form a top opening and a bottom opening, respectively, when the base is in the closed position;

a base battery fixed with the base;

the bottom edge of each part being at least partially covered with a conductive surface and electrically connected to opposing sides of the base battery;

a frustoconical cover fixable with the base when the base is in the closed position, the cover including an outer surface, an inner surface adapted to abut the outer surface of each part of the base, a top opening and a bottom opening;

the cover including at least two conductive inward projections proximate the bottom opening of the cover, each projection adapted for a snap fit with the bottom edge of the base to mechanically and electrically secure the cover to the base;

a plurality of cover LEDs fixed with the cover, each cover LED connected with the conductive projections of the cover to connect the cover LED to the base battery when the cover is engaged with the base to illuminate the cover LEDs.

9. The ponytail holder of claim 8 further including:

a cover controller electrically fixed between the cover LEDs and the base battery when the cover is engaged with the base, the cover controller controlling the color and intensity of the cover LEDs; and a cover mode switch electrically connected with the cover controller to alternate between illumination modes pre-programmed in the cover controller.

10. The ponytail holder of claim 9 wherein the cover controller further includes a wireless receiver for receiving a signal to command the cover controller to control the color and brightness of each cover LED.

11. The ponytail holder of claim 8 wherein the cover further includes a cover battery electrically connected to the base battery of the base in parallel when the cover is engaged with the base.

12. The ponytail holder of claim 8 wherein each part of the base further includes a plurality of freestanding parallel spikes projecting away therefrom, the spikes of both parts of the base being substantially mutually parallel when the base is in the closed position.

13. A ponytail holder, comprising:

a frustoconical base having first and second parts each mutually connected at a hinged edge and positionable between open and closed positions, each part having an inner surface, an outer surface, and a clasping edge opposite the hinged edge, the clasping edge of each part mutually, selectively fastenable to secure the base in the closed position, each part having a top edge and a bottom edge that together form a top opening and a bottom opening, respectively, when the base is in the closed position, the clasping edge of each part including electrical contacts that form an electrical clasp switch that is closed when the base is in the closed position and that is open when the base is in the open position;

a base battery fixed with the base and electrically connected with a plurality of base LEDs through a plurality of conductors fixed with the base so as to illuminate the base LEDs only when the clasp switch is closed.

14. The ponytail holder of claim 13 wherein the base further includes a base controller electrically connected between the base battery and the base LEDs through a plurality of conductors, controlling the color and intensity of the base LEDs through at least one program of the base controller.

15. The ponytail holder of claim 13 further including a frustoconical cover fixable with the base when the base is in the closed position, the cover including an outer surface, an inner surface adapted to abut the outer surface of each part of the base, a top opening and a bottom opening, the cover being at least partially non-opaque.

* * * * *